US006676544B2

(12) United States Patent
Tyke

(10) Patent No.: US 6,676,544 B2
(45) Date of Patent: Jan. 13, 2004

(54) GOLF BALL MARKING GUIDE

(76) Inventor: Charles R. Tyke, 5350 Corporate Grove Blvd., SE., Grand Rapids, MI (US) 49512

( * ) Notice: Subject to any disclaimer, the term of this patent is extended or adjusted under 35 U.S.C. 154(b) by 252 days.

(21) Appl. No.: 09/755,428

(22) Filed: Jan. 4, 2001

(65) Prior Publication Data

US 2001/0053721 A1 Dec. 20, 2001

Related U.S. Application Data

(60) Provisional application No. 60/181,180, filed on Feb. 9, 2000.

(51) Int. Cl.[7] ..... A63B 57/00; B25D 5/00; B31F 1/07; B41F 17/00

(52) U.S. Cl. ..... 473/406; 473/480; 473/285; 473/257; 473/353; 101/4; 101/35; 101/127.1; 101/DIG. 40; 224/918; 33/574

(58) Field of Search ..... 101/4, 5, 35, 114, 101/127, DIG. 40; 473/257, 237, 280, 285, 406; 40/327; 292/256.67; 224/918; 220/DIG. 31, 4.02, 4.06, 4.21, 4.22, 4.23, 4.25, 4.24; 33/508, 574–579

(56) References Cited

U.S. PATENT DOCUMENTS

| | | | | | |
|---|---|---|---|---|---|
| 849,600 | A | * | 4/1907 | Cory | 101/4 |
| 1,476,203 | A | * | 12/1923 | Horne | 101/4 |
| 1,537,685 | A | * | 5/1925 | Ladd | 101/4 |
| 1,641,562 | A | * | 9/1927 | Will et al. | 101/4 |
| 2,005,787 | A | * | 6/1935 | Humphrey | 101/35 |
| 4,086,851 | A | | 5/1978 | Brandell | |
| 4,244,470 | A | * | 1/1981 | Burnham | 220/4.23 |
| 4,432,551 | A | | 2/1984 | Chen | |
| 4,441,716 | A | | 4/1984 | Chen | |
| 4,603,862 | A | | 8/1986 | Chen | |
| 4,974,511 | A | | 12/1990 | Hsi-Chou | |
| 4,981,022 | A | * | 1/1991 | Snyder | 62/430 |
| 5,108,106 | A | | 4/1992 | Cook | |
| 5,133,556 | A | | 7/1992 | Karasavas | |
| 5,409,228 | A | | 4/1995 | Botsch | |
| 5,564,707 | A | | 10/1996 | Dinh | |
| 5,713,799 | A | | 2/1998 | Balmat | |
| 5,743,180 | A | | 4/1998 | Arnke | |
| 5,878,659 | A | * | 3/1999 | Hatter | 101/35 |
| D411,598 | S | | 6/1999 | Disco | |
| 6,004,223 | A | * | 12/1999 | Newcomb | 473/257 |
| 6,216,587 | B1 | * | 4/2001 | Foley | 101/35 |
| 6,324,971 | B1 | * | 12/2001 | Urban | 473/285 |

OTHER PUBLICATIONS

Line–a–Putt Product Literature.
Spot Liner Product Literature.

* cited by examiner

*Primary Examiner*—Paul T. Sewell
*Assistant Examiner*—Mitra Aryanpour
(74) *Attorney, Agent, or Firm*—Waters & Morse P.C.

(57) ABSTRACT

A golf ball marking guide has opposing first and second body portions. Each body portion has opposing front and back ends and opposing top and bottom edges. The body portions also have a drawing slot positioned between the opposing top and bottom edges and extending at least partially between the front and back ends. The body portions also have generally spherical concave inner surfaces. A tab extends from the front of the first body portion in a direction generally away from the body portion back. Another tab extends from the front of the second body portion in a direction generally away from the body portion back. A connector is provided at the back of the first body portion. A cooperating connector is also provided at the back of the second body portion. The two connectors are coupled, one with the other, whereby the two body portions are aligned with each other, their inner surfaces face each other and define a spherical frustum, and the two tabs are aligned with each other.

4 Claims, 3 Drawing Sheets

GOLF BALL MARKING GUIDE

CROSS-REFERENCES TO RELATED APPLICATIONS

This is a continuing application of co-pending U.S. Provisional Patent Application Ser. No. 60/181,180, entitled GOLF BALL MARKING GUIDE and filed on Feb. 9, 2000 by Charles R. Tyke, now co-pending, the disclosure of which is incorporated here by reference.

STATEMENT REGARDING FEDERALLY SPONSORED RESEARCH OR DEVELOPMENT

Not Applicable.

BACKGROUND OF THE INVENTION

The invention relates to golfing accessories and more particularly to putting aides including a device that facilitates marking golf balls. The putting of a golf ball has long been considered a distinct and different element of the game of golf as compared to striking the ball with any other golf club. The practice of putting a golf ball has an equally long history of development of aids to help the golfer putt more accurately. A majority of these prior aids, including both devices and markings upon the golf ball have not complied with the formal rules of playing golf, however. Thus, a continuing quest for a development that facilitates accurate putting and compliance with the rules of play endures.

BRIEF SUMMARY OF THE INVENTION

Accordingly, a golf ball marking guide of the invention facilitates the marking of a golf ball with indicia that helps the golfer align and target the putting of the ball, while complying with the rules of play. More particularly, the golf ball marking guide has opposing first and second body portions. Each body portion has opposing front and back ends and opposing top and bottom edges. The body portions also have a drawing slot positioned between the opposing top and bottom edges and extending at least partially between the front and back ends. The body portions also have generally spherical concave inner surfaces. A tab extends from the front of the first body portion in a direction generally away from the body portion back Another tab extends from the front of the second body portion in a direction generally away from the body portion back. A connector is provided at the back of the first body portion. A cooperating connector is also provided at the back of the second body portion. The two connectors are coupled, one with the other, whereby the two body portions are aligned with each other, their inner surfaces face each other and define a spherical frustum, and the two tabs are aligned with each other.

These and other features, objects, and benefits of the invention will be recognized by one having ordinary skill in the art and by those who practice the invention, from the specification, the claims, and the drawing figures.

DETAILED DESCRIPTION OF THE INVENTION

Figure 1:
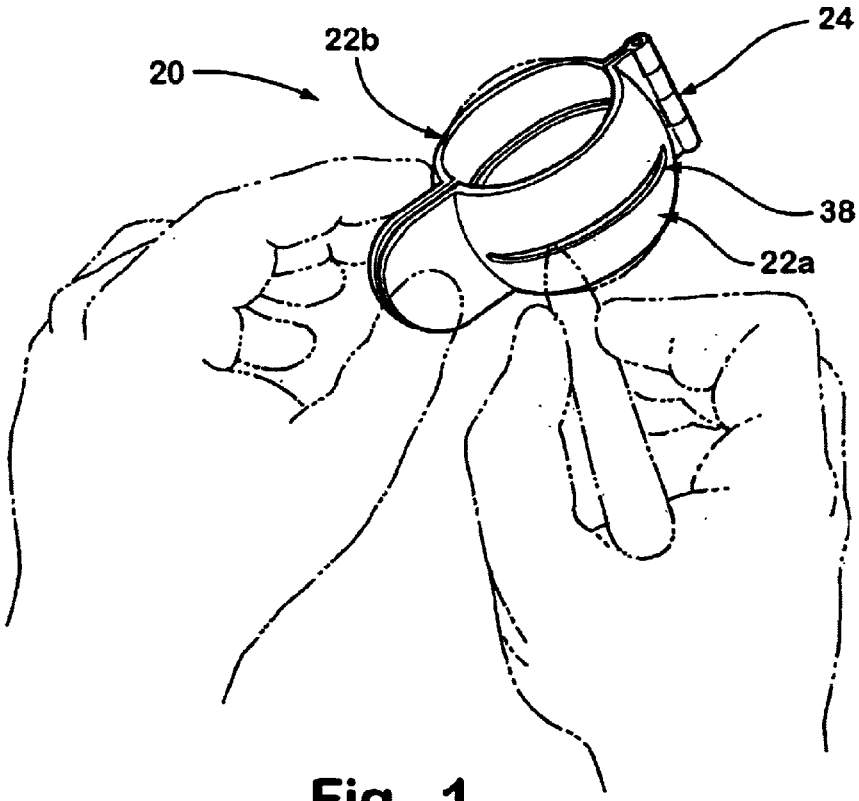
FIG. 1 is a perspective view of a golf ball marking guide according to the invention, showing the guide in a closed position and a user's hands in phantom.
Figure 2:
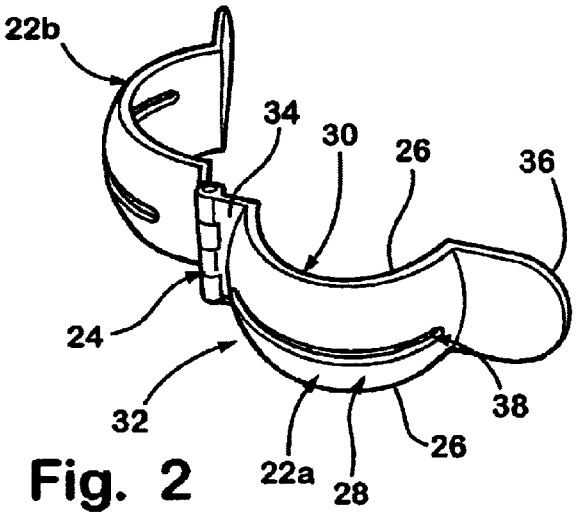
FIG. 2 is another perspective view thereof, in an open position.
Figure 3:
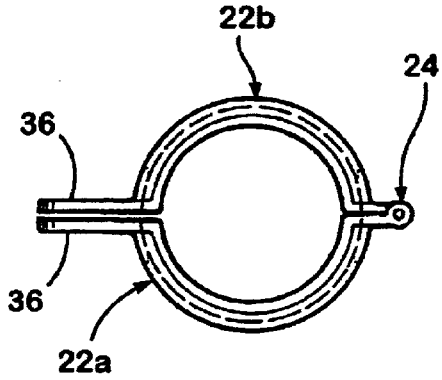
FIG. 3 is a side elevational view thereof, showing a ball in phantom.
Figure 4:
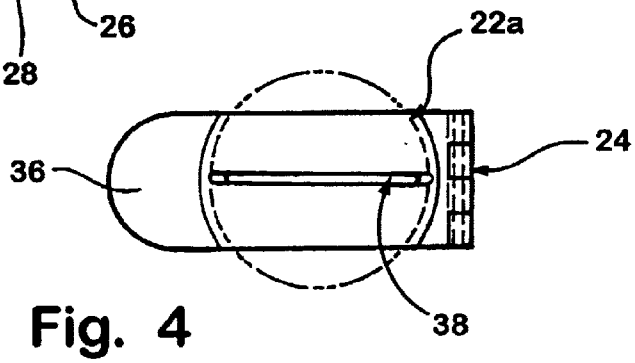
FIG. 4 is a top plan view thereof.
Figure 5:
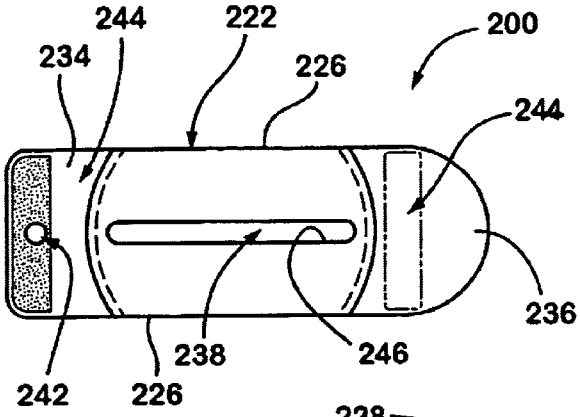
FIG. 5 is a side elevational view of a first alternative embodiment thereof.
Figure 9:
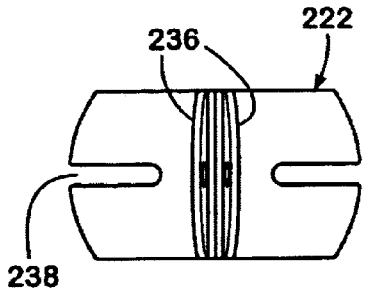
FIG. 9 is a front elevational view thereof.
Figure 6:
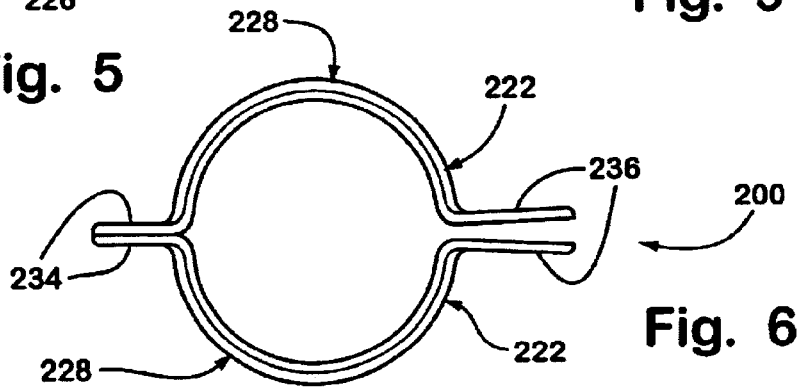
FIG. 6 is a top plan view thereof.
Figure 8:
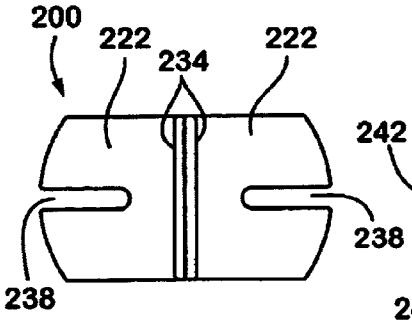
FIG. 8 is a back end elevational view thereof.
Figure 7:
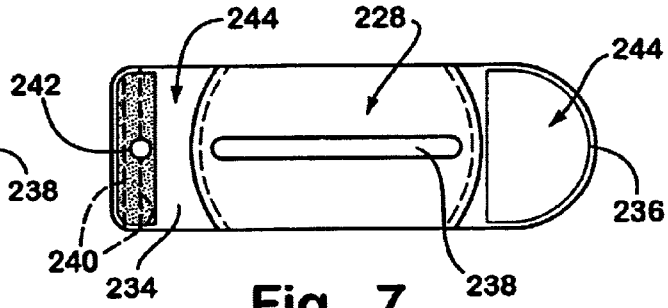
FIG. 7 is an opposing side elevational view thereof.

A golf ball marking guide of the invention is generally shown in the drawing figures. More particularly, a first embodiment 20 is generally shown in drawing FIGS. 1–4 and a second embodiment 200 is generally shown in drawing FIGS. 5–15. Each of the embodiments is preferably a clam shell device with two substantially similar halves. Further, each guide is most preferably fabricated as a plastic molding, more specifically ABS plastic, although other structural materials and appropriate methods may be used. A ball marking guide according to the invention may alternatively be constructed of wood, metal, or ceramic, and various plastics, for example.

The guide 20 is constructed with two substantially identical half members 22*a* and 22*b*. Each guide half 22*a* and 22*b* has opposing side edges 26 that are substantially parallel. A spherical section or body portion 28 is defined between the side edges 26 and has opposing concave inner 30 and convex outer surfaces 32. A connector 34 is formed at one end of each guide half 22 and a grasping tab 36 is formed at an opposing end of the guide half. Further, a guide drawing slot 38 extends between the inner and outer surfaces 30 and 32, respectfully, and along a length of the body portion 28, between the opposing ends The halves 22*a* and 22*b* are inverted and aligned with one another and may be coupled with a hinge 24. The halves hinge between open (FIG. 2) and closed (FIG. 1) positions. In the open position, a ball (shown in phantom) may be positioned into or removed from the guide 20. While a pin hinge is shown for the guide 20, one having ordinary skill in the art will know that various other styles of hinge, including a living hinge, for example, may alternatively be used without departing from the concept of the invention.

With a ball positioned in the guide 20, the guide may be grasped by the tabs 36, in the closed position, holding the ball securely. So positioned, a permanent or non-permanent marking implement (shown in phantom in FIG. 1) may be used to draw an equatorial line about the ball along the slot 38. Either edge 26 of the guide may also be used to draw sectional lines about the ball. The opposing side edges 26 of the guide are noted to be substantially parallel with one another and with the guide drawing slot 38. Further, a user will readily see that the guide slot 38 does not fully circumnavigate the guide 20 or the ball. The user will also readily see that a closed equatorial line about the ball may be drawn merely by drawing two equatorial line segments in the slots 38, rotatably repositioning the ball about ninety degrees, and connecting the ends of the line segments.

The second embodiment 200 of a guide according to the invention is substantially similar to the first embodiment 20. Most notably the second embodiment omits the hinge of the first embodiment and uses a rigid attachment of the two guide halves instead. Further details of the guide 200, discussed below may also be applied to the guide 20 above.

The guide halves 222 are formed with connecting tabs 234 opposite grasping tabs 236. The connecting tabs 234 may be connected together by various methods, including the use of an adhesive or by thermal welding, for example. As is more specifically shown in the drawing FIGS. 5–15, so called energy bars 240 (FIG. 12) may be formed on an inner surface 230 of the connector tabs 234 for ultrasonic welding of the connector tabs together as will be understood by one having ordinary skill in the art.

A key ring 242 hole or the like may be provided through the attachment tabs. One may also see that the hole 242 can be useful in aligning the halves 222 for assembly. Promotional display or labeling areas 244 may also be provided on the outside surfaces of the connector tabs 234. Labeling areas may also be provided on the outside surfaces of the grasping tabs 236.

Figure 11A:
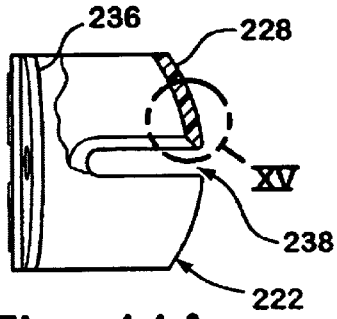
FIG. 11A is the view of FIG. 8, showing the other of the two halves of the guide unassembled.
Figure 15:
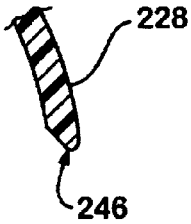
FIG. 15 is an enlarged fragmentary cross-sectional view of a detail of FIG. 11A.
Figure 14:
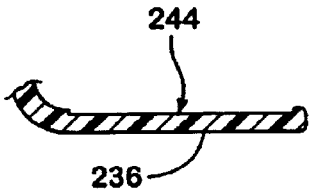
FIG. 14 is an enlarged fragmentary cross-sectional view of detail XIV of FIG. 10.
Figure 10:
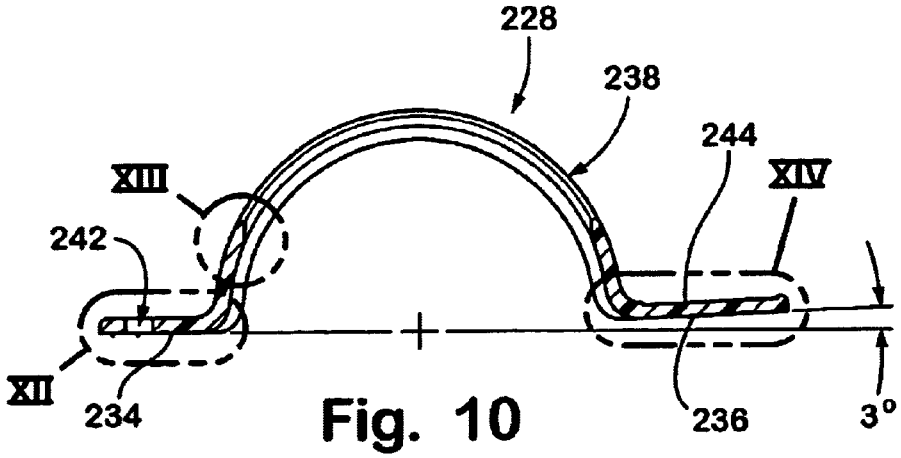
FIG. 10 is a cross-sectional view along line X—X of FIG. 5.
Figure 11:
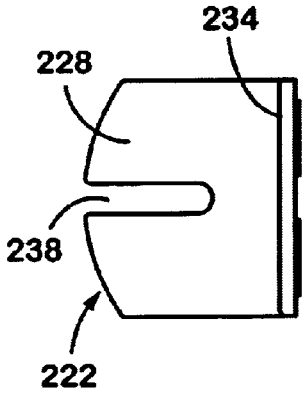
FIG. 11 is the view of FIG. 8, showing one of the two halves of the guide unassembled.
Figure 7A:
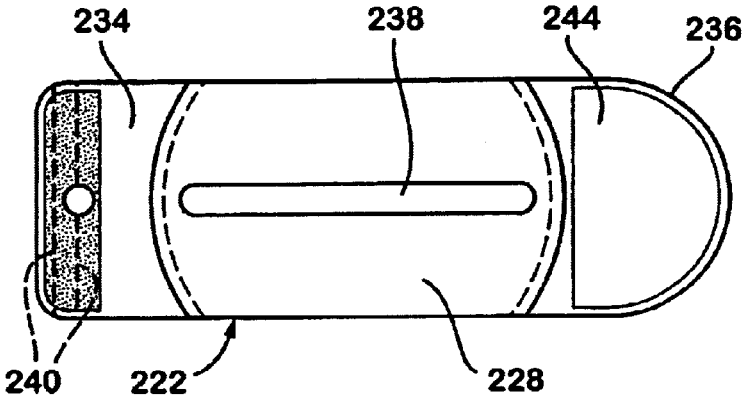
FIG. 7A is the view of FIG. 7.
Figure 12:
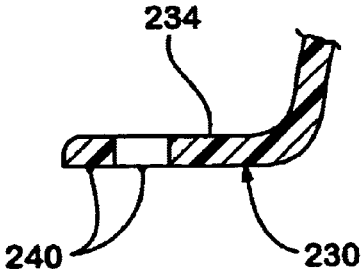
FIG. 12 is an enlarged fragmentary cross-sectional view of a detail of FIG. 10.
Figure 13:
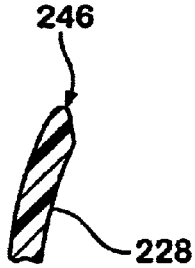
FIG. 13 is an enlarged fragmentary cross-sectional view of a detail of FIG. 10.

The guide drawing slot 238 is defined by a perimeter wall or chamfered (FIGS. 11A and 15). One having ordinary skill in the art will appreciate that the use of a felt tip marker or the like may cause "bleed-back" of ink between the ball and the guide body 228 when an equatorial line is drawn, if the perimeter wall were simply a square-cut or otherwise blunt surface. Thus, the side edges 226 are also most preferably chamfered.

In use, the grasping tabs are separated and a ball is inserted between opposing halves 22 or 222 of a marking guide 20 or 200 and seated in the concave spherical inside surfaces 30 or 230 of the two opposing halves of the guide. The grasping tabs 36 or 236 are then grasped together, typically between the thumb and forefinger of a user's hand, which effectively clamps the ball in place. An equatorial line segment may then be drawn using a preselected drawing implement and inserting the drawing tip of the implement into the guide drawing slot 38 or 238 and rubbing the tip along the surface of the ball as the tip is moved from one end of the guide slot to the opposing end. This activity may be repeated for the other guide slot. Further, the opposing side edges 26 or 226 of the marking guide may be used to draw circle segment lines parallel to the equatorial line. Because of the grasping tab area and the opposing connector tab area of the guide halves, and because of structural considerations, the guide slot allows only a partial equatorial line segment to be drawn without rotating the ball. Thus, the user's grip on the grasping tabs may be relaxed and the ball rotated or repositioned to continue drawing an equatorial line completely around the circumference of the ball.

It will be understood by one having ordinary skill in the art and by those who practice the invention, that various modifications and improvements may be made without departing from the spirit of the disclosed concept. Various relational terms, including left, right, front, back, top, and bottom, for example, are used in the detailed description of the invention and in the claims only to convey relative positioning of various elements of the claimed invention. The scope of protection afforded is to be determined by the claims and by the breadth of interpretation allowed by law.

I claim:

1. A golf ball marking device for placing a putting alignment mark on a golf ball, comprising:

first and second body portions formed in the shape of a pair of opposed clam shell members having spherically shaped inner and outer shell surfaces, the shell members extending between front and back ends and between spaced side edges, the inner shell surfaces being shaped to mate with opposite sides of a golf ball;

opposed connector tabs extending outwardly from the back ends of the shell members, the connector tabs being fastened together at a position spaced outwardly from the back ends of the shell members;

opposed grasping tabs extending outwardly from front ends of the shell members, the grasping tabs being separable sufficiently to insert a golf ball in an open interior in the marking device, the opposed grasping tabs being spaced apart when a golf ball is positioned in the marking device, by a distance that permits the opposed shell members to be resiliently damped in a fixed position substantially all of the way around the periphery of the ball by squeezing the grasping tabs together between the thumb and forefinger of one hand, the grasping tabs being separable sufficiently for movement or removal of the golf ball after the ball has been marked;

opposed equatorial marking slots extending through the opposed shell members and extending at least part of the way between the front and back ends of the shell members, each slot having spaced side edges and an open interior, the open interior being wide enough that the tip of an ink marking pen can be inserted through the slot into marking contact with a ball held within the device and moved along the slot to make an equatorial line on the ball, the slots extending at least partially around each shell member and being aligned, such that aligned equatorial marks can be made on each side of a ball with an ink pen held in one hand while holding the ball securely in the marking device by grasping the grasping tabs with the other hand; and an ink marking pen having a tip that fits through the slots to mark a ball.

2. A golf ball marking device as in claim 1, wherein the body portions comprise open outer sides that are defined by the side edges of the shell members, the side edges being arcuate and lying in planes parallel with the plane of the equatorial slots, such that auxiliary marks parallel to the equatorial marks can be placed on a golf ball using the outer side edges of the shell members.

3. A golf ball marking device as in claim 1, wherein the connector tabs are ultrasonically welded together adjacent outer ends thereof.

4. A golf ball marking device as in claim 1, wherein the side edges of each slot include opposed sidewalls that are beveled downwardly and outwardly as they extend from the outer shell surface to the inner shell surface of the shell member, such that the marking pen, when inserted through the slot, is less likely to engage the inner edge of the slot adjacent a golf ball being marked.

* * * * *

UNITED STATES PATENT AND TRADEMARK OFFICE

CERTIFICATE OF CORRECTION

PATENT NO. : 6,676,544 B2
DATED : January 13, 2004
INVENTOR(S) : Charles R. Tyke It is certified that error appears in the above-identified patent and that said Letters Patent is hereby corrected as shown below:

Column 3,
Line 32, -- 246, which is preferably beveled -- should be inserted before “or”

Column 4,
Line 25, the word “damped” should be -- clamped --

Signed and Sealed this

Eleventh Day of May, 2004

JON W. DUDAS
*Acting Director of the United States Patent and Trademark Office*